United States Patent [19]

Chartier

[11] Patent Number: 4,782,874

[45] Date of Patent: Nov. 8, 1988

[54] CONVERTIBLE PURSE AND TOTE BAG

[76] Inventor: Elisibeth Chartier, 153 S. Reeves Dr., Beverly Hills, Calif. 90212

[21] Appl. No.: 97,600

[22] Filed: Sep. 16, 1987

[51] Int. Cl.[4] ..... A45C 3/04; A45C 3/06; A45C 7/00; A45C 13/10

[52] U.S. Cl. ..... 150/112; 150/113; 150/116; 150/117; 383/2; 383/4

[58] Field of Search ..... 383/2, 4; 150/100, 101, 150/106, 112, 117, 133, 111, 113; D3/43, 48, 71; 190/1, 107

[56] References Cited

U.S. PATENT DOCUMENTS

| | | | |
|---|---|---|---|
| D. 157,266 | 2/1950 | Kiernan | 150/117 X |
| D. 226,743 | 4/1973 | Lee | D3/48 X |
| 2,038,952 | 4/1936 | Niedorff et al. | 383/1 X |
| 2,164,641 | 7/1939 | Davenport | 383/2 X |
| 2,527,059 | 10/1950 | DiMezza | 150/117 |
| 2,682,290 | 6/1954 | Ditlea | 383/4 X |
| 2,802,501 | 8/1957 | Stember | 150/101 |
| 3,830,348 | 8/1974 | Ohyama | 383/2 X |
| 3,989,080 | 11/1976 | Koszegi | 383/2 X |
| 4,011,898 | 3/1977 | Hubbard | 383/4 X |
| 4,078,595 | 3/1978 | Mittelmann | 383/2 X |
| 4,117,874 | 10/1978 | Berenguer | 383/2 X |

FOREIGN PATENT DOCUMENTS

| | | | |
|---|---|---|---|
| 58258 | 8/1937 | Norway | 150/106 |
| 85830 | 3/1936 | Sweden | 150/117 |

*Primary Examiner*—Sue A. Weaver

[57] ABSTRACT

A small, flat purse or wallet, having internal compartments with closeable openings adapted for holding and carrying a variety of small personal articles, such as keys, change, passports and the like, includes a larger tote bag attached to the purse in a flat, folded condition and contained entirely within one of the compartments. When the bag is fully deployed from the compartment and turned inside out, the purse is securely disposed flat against an inside surface of the bag, with the openings into the compartments accessible only from within the bag. After use, the bag is folded back into the purse for storage and reuse.

5 Claims, 2 Drawing Sheets

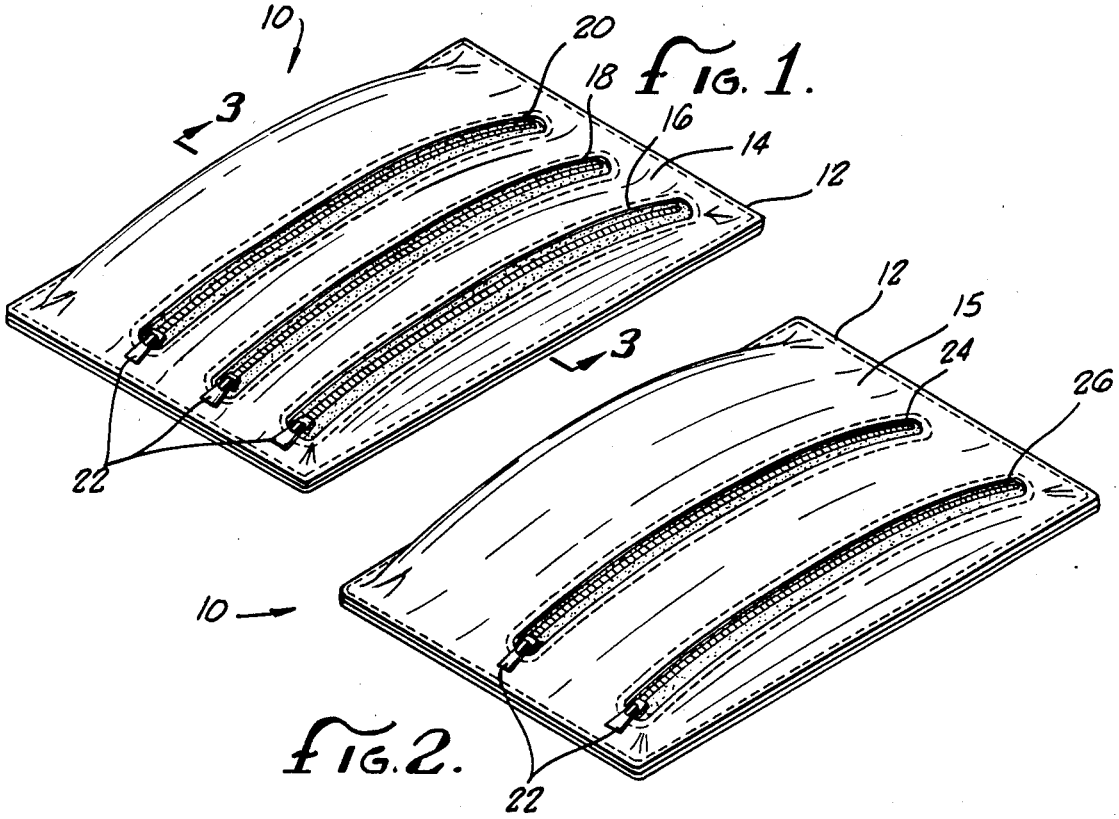
FIG. 1.
FIG. 2.
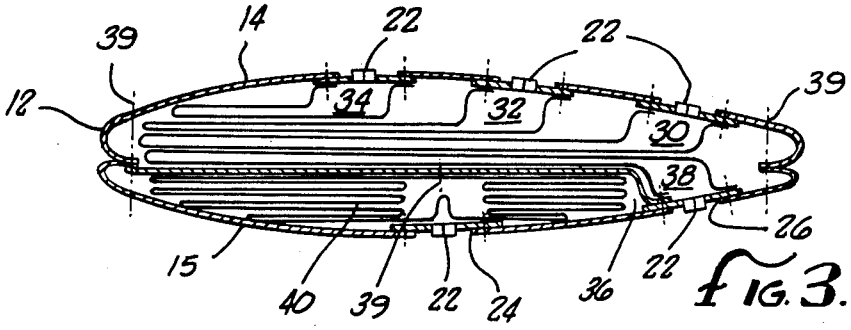
FIG. 3.
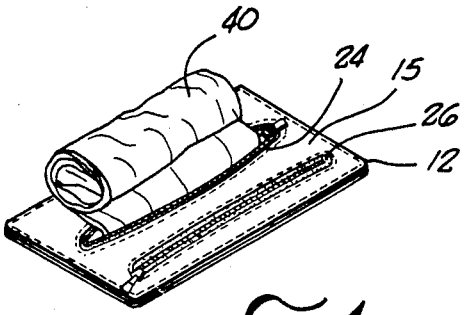
FIG. 4.

CONVERTIBLE PURSE AND TOTE BAG

BACKGROUND OF THE INVENTION

1. Field of the Invention

In generally, this invention relates to clothing accessories, and in particular, to carriers for personal articles.

2. Description of the Related Art

Shoppers and travelers of both sexes frequently encounter the situation where the small wallet, purse or handbag they carry for holding and carrying small, personal articles, such as money, credit cards, keys, passports and the like, is too small for holding and carrying larger articles acquired during the course of a day's shopping or travels. This is particularly true when the acquisition is unexpected, such as an impulse purchase.

In this country, it is common for stores and shops to provide their customers with a sack or bag for their purchase, usually one made of paper or plastic, and typically including a pair of handles, for carrying larger articles purchased on the premises. These bags typically will bear the seller's trademark or logo and are not intended for multiple reuse, although some of the newer plastic bags are quite strong and durable. Regardless of their material or configuration, however, these bags are seldom either stylish in appearance or adapted for convenient carrying upon the person for reuse.

In foreign countries, the gratuitous provision of a sack or bag for purchased articles by their seller is less common, and where available, the sack or bag must be purchased separately at a cost over that of the items purchased. Thus, the traveller or shopper who neglects to bring along a carrying bag may find himself or herself in the position of having to make an additional, unwanted purchase, and regardless, may be cast in the unwelcome role of an unstylish, "walking billboard" for the store from which the bag was acquired.

As a visit to any well-stocked department store will show, there are a wide variety of attractive, stylish and functional carriers for small, personal articles. These include men's and women's wallets and purses which snap, zip or unlock in a variety of ways to reveal a large number of compartments adapted to store and secure the small, indispensable personal items that most of us carry when we venture out, such as money, credit cards, identification, combs and compacts, photographs, keys and the like. These are typically made of skins or leathers of one kind or another, or less-expensive material, such as plastic or synthetic fabrics.

Likewise, there are a large number of convenient, reusable tote bags or carriers on the market for carrying larger articles, although these are less commonly found than the ubiquitous wallet or purse. These range from the more utilitarian canvas or duck cotton tote bags usually associated with casual activities, such as beachwear or swimming, to the more stylish, elaborate and multi-compartmentalized overnight bags favored by some women as a general carryall. They may be woven from natural fabrics, such as coir or palm, and may be soft-sided or semi-rigid.

Unfortunately, it appears that what is on the market falls distinctly into either one category or the other, i.e., there does not seem to be a carrier which, in one configuration, is a stylish purse or wallet adapted for carrying smaller articles and which, in the appropriate circumstances, can be easily converted or expanded to an attractive tote bag or carrier for larger articles.

SUMMARY OF THE INVENTION

The present invention provides an accessory which in one configuration, is a carrier adapted to receive and carry small personal articles, and which can be conveniently and reversibly converted into a second configuration adapted to hold and carry larger articles. As will be shown, such a carrier can be fabricated easily and inexpensively from a wide variety of stylish and attractive materials, and is suitable to be conveniently carried by both men and women.

The carrier comprises a purse having openings into distinct internal compartments which are sized to receive small personal articles, such as money, keys and the like, and a large, tote bag or sack which folds to fit entirely within a compartment of the purse. The sack is attached to the purse within the compartment such that when the bag is extracted from the compartment and turned inside out, the purse resides securely inside the bag and is attached to one of its interior surfaces, preferably the floor, with the openings into the compartments accessible only from the inside of the bag.

In one embodiment, the purse is sized to receive an average passport and can be fabricated from a variety of attractive and durable materials. The openings into the compartments are preferably secured by closure means, such as a conventional zipper or VELCRO-brand closure strips, and the purse may include appropriately-sized straps for carrying on the wrist or shoulder.

The bag has a closed bottom, generally upright sidewalls, an open top, and in a preferred embodiment, a pair of foldable handles disposed on opposite sidewalls at the open top for grasping with the hand.

A better understanding of these and other features and advantages of the present invention may be had from a consideration of the following detailed description of the exemplary, preferred embodiments, particularly when read in conjunction with the appended drawings, of which the following is a brief description.

BRIEF DESCRIPTION OF THE DRAWINGS

FIG. 1 is a perspective view of a convertible carrier in accordance with the present invention, in a retracted configuration;

FIG. 2 is a perspective view of the rear of the carrier in FIG. 1;

FIG. 3 is an enlarged cross-sectional view taken along line 3—3 taken in FIG. 1;

FIG. 4 is a view similar to FIG. 2, on a reduced scale, showing the carrier with a folded tote bag being extracted from an unzipped compartment;

DETAILED DESCRIPTION OF THE PREFERRED EMBODIMENTS

Figure 5:
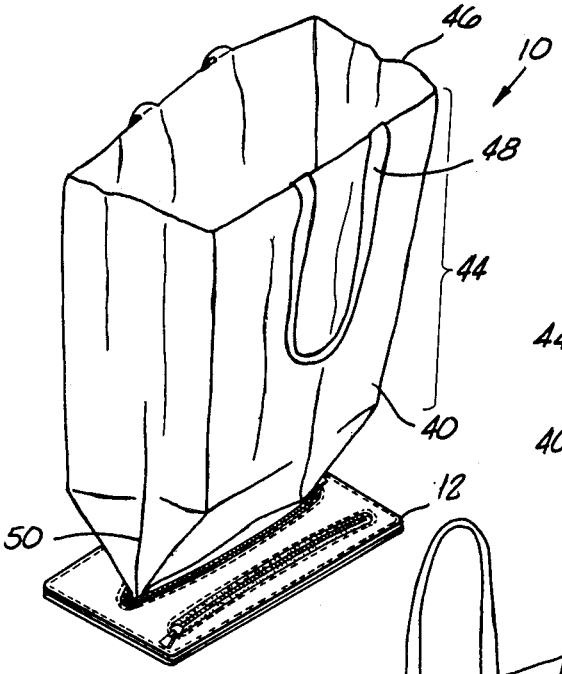
FIG. 5 is a view similar to FIG. 4 with the tote bag completely extracted from the compartment.

FIGS. 1 and 2 illustrate, in perspective form, a carrier 10 in accordance with the present invention. The carrier 10, in the retracted, or compressed state, comprises a relatively small, flat purse, wallet or handbag 12 having opposite front and rear faces 14 and 15, as illustrated in the respective figures.

In the exemplary preferred embodiment illustrated, the purse or wallet 12 is rectangular in shape and about 4.25 inches wide by 7.25 inches long, a size which is well adapted for carrying, e.g., in a woman's handbag or in the breast pocket of a man's coat, and to contain a variety of small, personal articles, such as a passport.

The front face 14 of the purse 12 includes a plurality of long, narrow, closable apertures or openings 16, 18 and 20 disposed at intervals along its width, each incorporating some means for closing the opening securely, such as a zipper 22, as illustrated. Although zippers are illustrated, skilled practitioners will recognize that other closure means can be incorporated with equal facility, such as hook-and-loop fastener strips (e.g., those sold under the designation VELCRO).

As illustrated in FIG. 2, the rear face 15 of the purse 12 is characterized as including at least one more-or-less centrally-disposed opening 24, and may include one or more additional openings 26.

As shown in the cross-section of FIG. 3, the purse or wallet comprises a plurality of distinct, differently-sized, lined internal compartments 30, 32, 34, 36 and 38. Several of these compartments 30, 32 and 34 are accessible from the front face 14 through zippered openings 16, 18 and 20, respectively, and are adapted in size to receive a variety of small articles typically carried on the person, e.g., coins, credit cards, a comb and the like.

A rear compartment 36 is accessed by means of the centrally-disposed opening 24 through the rear face 15. The rear face may also provide access to others of the interior compartments, such as the compartment 38 illustrated.

As will be evident from the drawings, the purse or wallet 12 is relatively simple in its fabrication and construction. A plurality of layers of a sheet material are cut by means of patterns, folded and aligned, and stitched at appropriate margins to join them in stitched seams 39 and define the purse. The purse can be fabricated from a wide variety of stylish and attractive materials, and purses have been fabricated of silk, rayon, dacron, and sturdy rip-stop nylon. Other natural materials which provide an attractive finish are kid-skin leather and ostrich leather. The lining of the compartments can match, or complement, the material of the purse itself, and nylon and satin have been utilized successfully.

It is to be understood that the materials and fabrication of the purse 12 are not necessarily limited to fabrication by sewing of naturally-ocurring materials, however. Skilled practitioners will recognize that the compartmentalized purse 12 illustrated in FIG. 3 is also amenable to fabrication from inexpensive synthetics, such as plastic, and being joined and assembled by mass-fabrication techniques, such as bonding or heatwelding.

It will also be noted that, in the carrier 10 illustrated in the figures, the internal compartments are oriented in one direction within the purse, that is, their respective openings are oriented toward one side of the purse and away from the compartments' bottoms, which are oriented toward the purse's other side. If the compartments were oriented otherwise, i.e., extending in both directions, it is possible that the contents of some of the compartments inadvertently left open would spill out when the purse was turned up to permit access to the contents of oppositely-oriented compartments.

Disposed in a folded condition within the rear compartment 36 of the purse, and accessed through the centrally-disposed opening 24 in the rear face 15, is a sack or tote bag 40 for carrying larger articles (see FIGS. 3 and 4). The tote bag 40 may take a variety of shapes, but in the preferred embodiment illustrated, has a rectangular transverse cross-section which is only slightly larger than a face of the purse or wallet 12, and a depth, when fully deployed, of about 13 inches. The bag includes a closed bottom 42, generally upright sidewalls 44, an open top 46, and preferably, a pair of foldable handles 48 disposed on opposite sidewalls at the open top for grasping with the hand, deploying the sack from the purse, and carrying the bag when deployed.

The bag may be made from a wide variety of materials, but preferably is cut from a cloth material which is easily sewn and which can accommodate pleats 50 (FIG. 5) which have a "memory", permitting the sack to be conveniently folded for flat storage within the rear compartment 36. Bag materials that have proven to be both sufficiently durable and strong and which may be obtained in a wide variety of patterns, colors and finishes include silk, nylon (especially rip-stop nylon), dacron and the heavier cottons. As in the case of the compartment linings, the material of the bag can be selected to match or complement the finish of the purse.

It will be noted that the bottom or floor 42 of the bag is attached to the purse 12 within the rear compartment 36 (see FIG. 3) by, e.g., a stitched seam 39. As shown in FIG. 3, the purse has a central partition that is joined to the rear face along the rear opening 26 and to the opposite margin of the purse, both by stitched seams 39, and extends across the other rear opening 24 and the bottom of the bag is joined to this partition by another stitched seam 39. It is, of course, feasible to provide the purse and bag separately, i.e., unattached to one another. However, it is believed that this would result in some loss of convenience and security for, as described more completely hereinafter, attachment of the bag to the inside of rear compartment 36 in the manner illustrated causes the purse to reside securely inside the bag and be attached flat against one of its interior surfaces, with the front face 14 accessible only from the inside of the bag, when the bag is in the fully-deployed condition.

Figure 6:
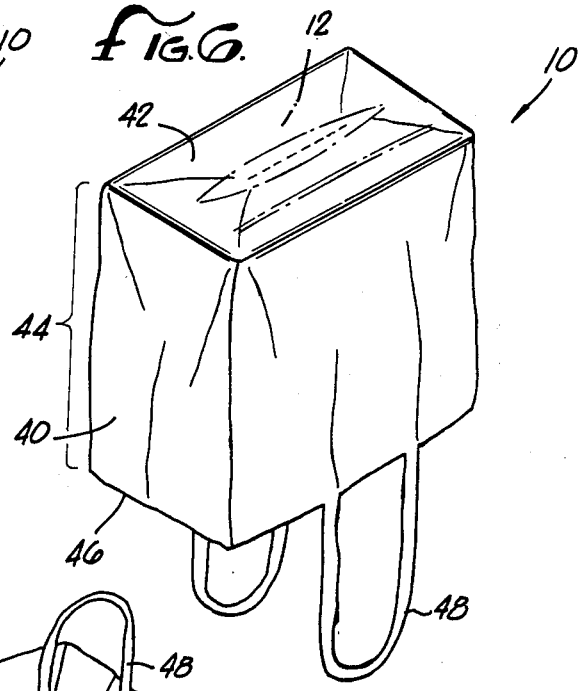
FIG. 6 is a perspective view of the carrier of FIG. 5 immediately after the tote bag has been turned inside out.
Figure 7:
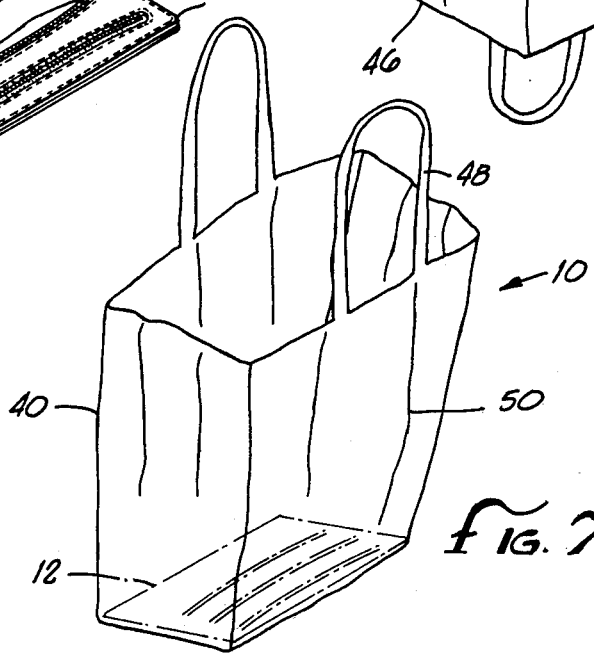
FIG. 7 illustrates the carrier of FIG. 6 in the upright, deployed configuration for holding and carrying large articles.

Deployment or extension of the bag 40 from the purse 12 is accomplished in a relatively straightforward manner, not unlike the deployment of a parachute. The procedure is illustrated serially in FIGS. 3-7. Initially, the bag resides within the rear compartment 36 in a flat, folded condition (see FIG. 3). Deployment is begun by unzipping or opening the centrally-disposed opening 24 in the rear face 15 and extracting all or a portion of the bag 40, as illustrated in FIG. 4. Thereafter, the bag is extended from the purse 12 by pulling on its top 46 or handles 48 until it is in a fully-extended position, as illustrated in FIG. 5. At this point, a hand is placed on the front face 14 of the purse underneath the extended assembly, while another hand holds the top 46 of the bag in a generally open condition to permit the purse and bottom of the bag to be brought upward through the open top of the bag. This causes the bag to be inverted, or turned inside out, with the closed bottom up and the open top down, as illustrated in FIG. 6. When turned upright, as illustrated in FIG. 7, carrier 10 is a large tote bag with the purse or wallet disposed flat against the bottom of the bag and securely attached to it, and with the openings on the front face of the purse facing up and accessible only from the inside of the bag.

It will be noted that, for the embodiment illustrated in the figures, the purse 12 resides flat against the bottom or floor 42 of the deployed bag and serves to reinforce the floor of the bag and space the sidewalls 44 apart at the bottom, giving it form. Further to this end, the purse 12 may be internally stiffened in the lateral direction by means of a thin, rectangular sheet of rigid material, such as a sheet of plastic or cardboard, if the purse is not sufficiently stiff or if the reinforcing and forming feature is not already provided by means of a passport or the like carried within the purse.

Figure 8:
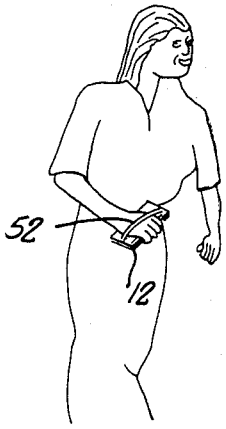
FIG. 8 is a schematic perspective view of a user with the carrier in the retracted configuration with an optional wrist-loop as it may be carried.
Figure 9:
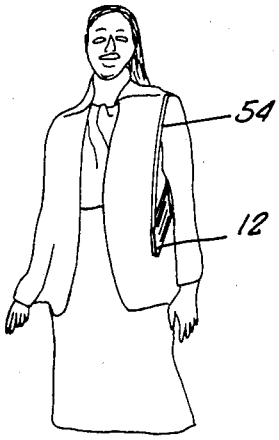
FIG. 9 is a schematic view similar to FIG. 8 showing the carrier in the retracted configuration and with an optional shoulder loop.
Figure 10:
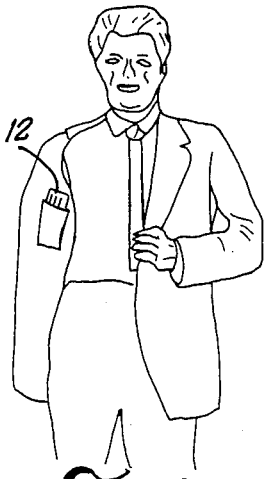
FIG. 10 is a schematic perspective view of another user with the retracted carrier worn within the vest pocket of a man's coat.

Skilled practitioners will recognize that the size and shape of the exemplary carrier 10 illustrated is well adapted for carrying within a woman's purse or, as illustrated in FIG. 10, the pocket of a man's coat. However, by the simple addition of a wrist-strap 52, or a longer shoulder strap 54, as illustrated in FIGS. 8 and 9, respectively, the carrier may be easily adapted for more conventional carrying upon the person. Optionally, these straps can be made easily removable, e.g., with snap hooks to convert the carrier from one version to another.

Indeed, it will be clear that a wide variety of carriers can be obtained by means of variations of their materials, shape, size and construction, depending upon the particular problem at hand. Accordingly, the embodiments discussed and illustrated herein should be taken as exemplary in nature only, and the spirit and scope of the instant application limited only by the claims appended hereto.

I claim:

1. A convertible purse and tote bag, comprising:

a purse having rectangular front and rear faces in generally side-by-side relation and joined together along the margins of said faces into a thin, flat and rectangular purse, said front face having at least two elongated and generally parallel front openings;

means defining a front compartment in said purse for each of said front openings, including a lining disposed inside said purse secured to said front face on opposite sides of the front opening, and closure means for the front opening;

said rear face having at least two elongated and parallel rear openings, one of said rear openings being centrally located in said rear face and the other being located along one margin of said rear face;

means defining a first rear compartment in said purse for said other rear opening, including a lining disposed inside said purse alongside the linings for said front openings, and closure means for said other rear opening;

means defining a second rear compartment in said purse for said centrally located rear opening and including closure means for said centrally located opening;

a tote bag composed of flexible fabric and disposed in said second rear compartment in a folded condition, said tote bag having a bottom joined to the inside of said purse, being of rectangular cross-sectional shape when unfolded, having an open end opposite said bottom, and being sized to receive the purse snugly within the bag at the bottom thereof with said rear face against the bottom and said front face facing up, whereby the tote bag may be withdrawn from said second rear compartment into the unfolded condition and inverted to dispose the purse entirely within the bag as a stiffening element for the bottom thereof.

2. A convertible purse and tote bag as defined in claim 1 wherein said closure means are zippers.

3. A convertible purse and tote bag as defined in claim 1 wherein said tote bag has a pair of folding handles at its open end.

4. A convertible purse and tote bag as defined in claim 1 wherein said means defining said second rear compartment include a central partition in said purse that is joined to said rear face along said other rear opening and extends across said central rear opening to the margin of said rear face, said bottom of said tote bag being joined to said partition.

5. A convertible purse and tote bag as defined in claim 4 wherein said means defining said first rear compartment extends along said central partition and across said purse.

* * * * *